US007556452B2

(12) United States Patent
O'Sullivan

(10) Patent No.: US 7,556,452 B2
(45) Date of Patent: Jul. 7, 2009

(54) CONTROL OF FLEXIBLE RISER CURVATURE AT THE KEEL OF A FLOATING STRUCTURE

(75) Inventor: James O'Sullivan, Houston, TX (US)

(73) Assignee: Technip France, Courbevoie (FR)

( * ) Notice: Subject to any disclaimer, the term of this patent is extended or adjusted under 35 U.S.C. 154(b) by 0 days.

(21) Appl. No.: 11/840,025

(22) Filed: Aug. 16, 2007

(65) Prior Publication Data

US 2008/0044233 A1 Feb. 21, 2008

Related U.S. Application Data

(60) Provisional application No. 60/822,561, filed on Aug. 16, 2006.

(51) Int. Cl.
*E21B 17/01* (2006.01)

(52) U.S. Cl. ..... 405/224.2; 405/168.1; 166/367

(58) Field of Classification Search ..... 405/168.1, 405/168.2, 223.1, 224, 224.2, 224.3, 224.4; 166/367, 350, 359
See application file for complete search history.

(56) References Cited

U.S. PATENT DOCUMENTS 5,722,492 A 3/1998 Finn
5,738,464 A * 4/1998 Delrieu ..... 405/202
6,176,646 B1 1/2001 Finn et al.
6,276,456 B1 8/2001 Head
6,386,798 B2 * 5/2002 Finn ..... 405/224.2
6,712,559 B2 * 3/2004 Lenormand et al. ..... 405/224.2

FOREIGN PATENT DOCUMENTS

WO WO 01/75262 10/2001

OTHER PUBLICATIONS

International Search Report for related PCT application (PCT/US2007/076128) dated Jan. 11, 2008.
Written Opinion of the International Searching Authority for related PCT Application (PCT/US2007/076128) dated Jan. 11, 2008.

* cited by examiner

*Primary Examiner*—Frederick L Lagman
(74) *Attorney, Agent, or Firm*—Klein, O'Neill & Singh, LLP

(57) ABSTRACT

A bend-limiting conduit controls the curvature of a catenary riser extending from the seafloor as it enters the centerwell of a spar-type offshore platform through the keel of the platform. The conduit has a bore dimensioned to receive the riser, and it extends from an upper end constrained within the keel to a lower end disposed below the keel. The conduit has increasing flexibility and weight per unit length from the upper end to the lower end, which results in a lateral load being applied to the riser as it passes through the conduit, thereby causing a gentle and gradual transition in the riser from a curved configuration at the lower end of the conduit, to a straight configuration as it emerges from the upper end of the conduit.

30 Claims, 3 Drawing Sheets

CONTROL OF FLEXIBLE RISER CURVATURE AT THE KEEL OF A FLOATING STRUCTURE

CROSS-REFERENCE TO RELATED APPLICATION

This applications claims the benefit, under 35 U.S.C. Section 119(e), of co-pending Provisional Application No. 60/822,561, filed Aug. 16, 2006, the disclosure of which is incorporated herein by reference in its entirety.

FEDERALLY-SPONSORED RESEARCH OR DEVELOPMENT

Not Applicable

BACKGROUND

This disclosure relates to the field of offshore drilling and production platforms, particularly spar-type platforms. More specifically, it relates to platforms, such as spar-type platforms, that are used in conjunction with production and/or export/import risers, either in a vertical or catenary configuration. Still more specifically, it relates to a mechanism for coupling a riser configured in a catenary configuration to a platform through a set of riser guides in the platform designed for a vertical riser configuration in a way that controls the curvature of the catenary curve-configured riser at the bottom or keel of the platform so as to reduce the stresses experienced by the riser as it enters the platform.

Spar-type offshore drilling and production platforms typically comprise an elongate buoyant hull supporting a deck on which drilling and production equipment is mounted, along with other structures (e.g., crew quarters, cranes, storage structures). The hull typically comprises a plurality of buoyancy tanks surrounding a central centerwell. The buoyancy tanks may extend to down to a ballasted keel, or they may be connected to the keel by a truss structure.

The platform is typically used in conjunction with one or more risers that extend under tension from the platform to the seafloor, either vertically or in a catenary configuration. In a typical catenary-configured riser arrangement, the lower end of each riser is connected to one end of a submarine pipeline or flow line that extends along the seafloor to a second end attached to a wellhead or some other structure on the seafloor. Each riser essentially extends from the flow line upwardly into an opening in the keel of the platform then upwardly through the centerwell to an upper end that is connected to production apparatus on the deck. A vertically-configured riser, on the other hand, extends to a fixed seabed structure below or nearly below, the platform.

The risers may be supported vertically at the surface by buoyant tensioning means attached to the risers in the centerwell, and they are restrained laterally by guide means located in the centerwell. A typical buoyant-tensioned riser arrangement in a spar-type platform is disclosed in U.S. Pat. No. 6,176,646, the disclosure of which is incorporated herein in its entirety. A riser may also be supported by a mechanical tensioning mechanism, typically located on the deck of the platform, comprising a combination of hydraulic pistons and cylinders and pneumatic accumulators functioning as a nearly constant-tension spring. A third type of support for a vertical riser is a fixed attachment to the hull of the platform, requiring the elasticity in the riser system to be supplied along the riser or at the seafloor. Regardless of the particular means employed for providing vertical support, the platform must be equipped with an array of vertical riser guide structures that constrain the lateral motion of the vertical riser as it passes through the platform hull.

One type of riser configured as a catenary is made of steel and is commonly called a "steel catenary riser" (SCR). The SCR is typically a length of steel pipe that defines a curved catenary configuration as it rises from the seabed to the keel of the platform. One important design consideration in the use of SCRs is the need to minimize static and dynamic stresses from bending moments on the riser at or near the keel. Specifically, an SCR must undergo a transition from a catenary curve to a straight linear (i.e., vertical) configuration. This transition produces a static bending moment in the SCR, which, in turn, creates stresses. In addition, the motion of the floating platform creates cyclical stresses on the riser that, over time, can result in fatigue and failure. Accordingly, it is desirable to reduce the static bending moments and dynamic stresses to the greatest extent possible. This can be done, for example, by running the SCR through a bend limiter at the keel, such as is disclosed in the aforementioned U.S. Pat. No. 6,176,646. The bend limiter, as its name implies, limits the degree of riser bending at the keel, whereby the riser configuration makes a gradual, as opposed to an abrupt transition from a catenary curve to a straight vertical line. Conventional bend limiters typically comprise a length of steel pipe having an inside diameter large enough for passage of the riser. While such prior art bend limiters do result in some limitation of the bending moment in the riser, they are fixed in geometry and cannot optimally support the dynamic motion of the riser relative to the platform. Furthermore, conventional bend limiters with fixed geometries typically cannot be run through the vertical riser guides in the centerwell of the platform, and thus the prior art bend limiters must be secured to or within the hull, independently of the available vertical riser guides.

SUMMARY OF THE INVENTION

As used herein, the terms "invention" and "present invention" are to be understood as encompassing the invention described herein in its various embodiments and aspects, as well as any equivalents that may suggest themselves to those skilled in the pertinent arts.

Broadly, the present invention is a bend limiting conduit or "stinger" for an SCR extending from the seafloor into the centerwell of a spar-type platform through the keel of the platform, wherein the bend limiting "stinger" extends from an upper end constrained within the keel of the platform to a lower end disposed below the keel, and defines a bore dimensioned to receive the SCR, characterized in that the stinger has progressively increasing flexibility or compliance from the upper end to the lower end. Advantageously, the stinger also increases in weight per unit length from the upper end to the lower end, with the stinger comprising a plurality of axial segments or sections joined end-to end, with the heavier segments or sections near the lower end, and the lighter segments or sections toward the upper end.

In a specific preferred embodiment, the stinger is formed from a series of steel pipe sections, or joints, of uniform inside diameter, joined axially (end-to-end), wherein each of the pipe sections or joints below the uppermost joint has an outside diameter that is slightly less than that of the joint immediately above it. This stepwise graduated reduction in the outside diameter with a constant inside diameter in successive joints is achieved by reducing the pipe wall thickness in each successive joint below the uppermost joint.

Also, in the preferred embodiment the weight per unit length is increased for each successive joint below the uppermost joint by applying a weighted "jacket" of increasing thickness on each successive joint below the uppermost joint. In a specific exemplary embodiment, the jacket comprises one or more layers of weighted metallic tape (e.g., lead tape) applied to the outside surface of each joint. Each successive joint below the uppermost joint is provided with a greater number of tape layers than the joint immediately above it. Alternatively, weighted collars or concrete cast directly onto the stinger joint may be installed on the pipe joints to create a desired weight distribution along the length of the stinger. The distribution of the weights makes the lower end of the bend limiting stinger heavier (per unit length) than the upper end, without significantly affecting the greater compliance (lower stiffness) of the lower end due to the lesser pipe wall thicknesses as compared to the upper end.

The maximum outside diameter of the stinger is less than the diameter of the openings in the vertical riser guides in the centerwell of the platform. This allows the bend-limiting stinger of the present invention to be installed from the deck of the platform by attaching it to the lower end of a casing that is then run down the centerwell through the riser guides until the upper end of the stinger is seated in the keel. The upper end of the casing is then secured at or near the top of the hull.

The bend-limiting stinger of the present invention is used with an SCR that extends from the seafloor up through the bore of the stinger and into the centerwell, where it assumes a vertical orientation as it extends up to the deck. Thus, upon entry into the lower end of the stinger, the SCR has a catenary curvature, and it exits from the upper end of the stinger in a vertical orientation. By constructing the stinger with increasing flexibility or compliance from its upper end to its lower end, and with similarly increasing weight per unit length, the SCR is made to transition gradually from its curved configuration to its vertical, linear configuration with little or no bending moment. The curvature of the SCR is controlled both by the distributed weight of the stinger, particularly along the more heavily-weighted lower portion, and by the graduated stiffness of the stinger, particularly along the less flexible upper portion. Furthermore, while the bend-limiting stinger of the present invention is of a smaller outside diameter than conventional bend limiters (so that it may pass through the riser guides, as discussed above), it can achieve better control of the curvature of the SCR than conventional bend limiters, due to its greater extent below the keel of the platform the aforementioned graduated transition in stiffness or flexibility and its above-described bottom-loaded weight distribution. Moreover, the bend-limiting stinger of the present invention is relatively compliant (not rigid), and thus it can move with the riser during dynamic motion of the hull, thereby reducing stresses imposed on the riser due to motion-induced changes in the riser curvature.

These and other advantages of the present invention will be better appreciated from the detailed description that follows.

DETAILED DESCRIPTION

As used herein, the terms "invention" and "present invention" are to be understood as encompassing the invention described herein in its various embodiments and aspects, as well as any equivalents that may suggest themselves to those skilled in the pertinent arts.

Figure 1:
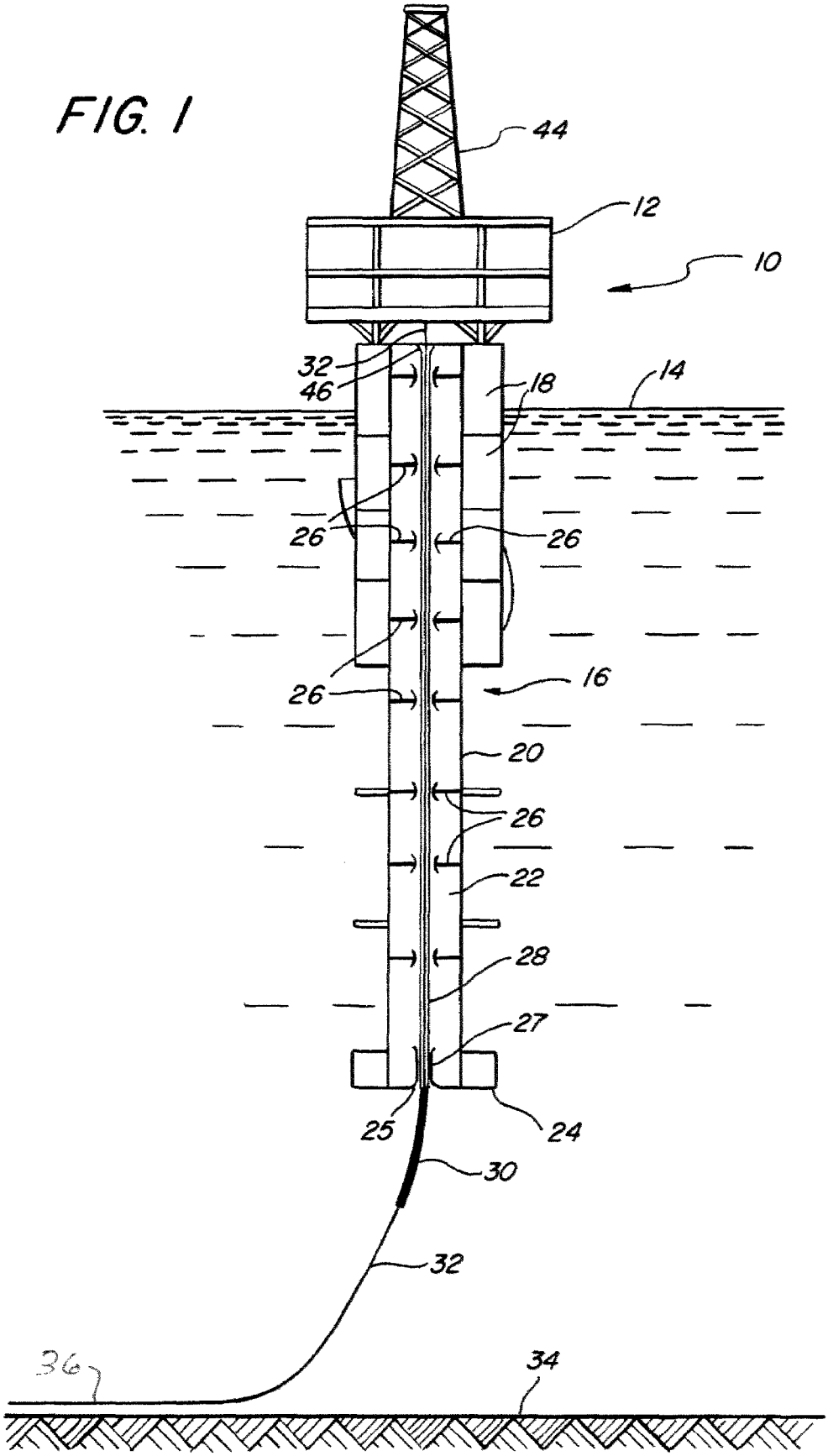
FIG. 1 is a cross-sectional view of a spar-type offshore platform showing an SCR extending into the platform through a bend-limiting stinger in accordance with the present invention.

FIG. 1 shows a spar-type platform 10 of conventional design. The platform 10 comprises a deck structure 12 supported above the surface 14 of a body of water by a buoyant hull 16. The hull 16, in turn, comprises an array of buoyancy tanks 18, some of which are "hard" tanks (air-filled), and some of which are "soft" tanks (floodable with water for adjustable buoyancy). The tanks 18 are arranged around a central column 20 that defines a centerwell 22. The bottom end of the central hull column 20 terminates in a ballasted keel 24 having a bottom opening or slot 25 that communicates with the centerwell 22. A plurality of riser guides 26 are disposed at spaced intervals along the length of the centerwell 22, with a keel slot guide 27 being disposed in the keel slot 25. The riser guides 26 define a passage through the centerwell 22 through which a riser casing 28 passes. (It is understood that the riser guides 26 and the keel slot guide 27 are typically configured to accommodate a plurality of casings.) The riser casing 28 extends from the keel slot 25, through the keel slot guide 27 and the riser guides 26, to the upper end of the hull 16, where it is fixed as described below.

As shown in FIG. 1, a bend-limiting stinger 30, described in detail below, is attached to the lower end of the casing 28 and extends downwardly from the keel 24. As explained below, the stinger 30 is formed of a plurality of pipe sections joined axially (end-to-end) to a total length that may typically range from about 100-150 meters. A riser 32 extends downwardly from the deck 12, through the casing 28 and the stinger 30 down to the sea floor 34, where it becomes a flow line 36 running along the sea floor 34 to a seafloor structure serving as a terminus, such as a well-head (not shown). The riser 32 is a flexible steel riser of a well-known type known as a steel catenary riser (SCR), formed of a plurality of steel pipe sections joined axially (end-to-end) to form a continuous, flexible conduit that defines a catenary curve as it traverses from the platform keel 24 to the sea floor 34.

As mentioned above, the riser 32 must be gradually straightened from its curved configuration between the keel 24 and the sea floor 34, to a linear, vertical configuration within the casing 28. This transition must be accomplished while limiting the bending moment applied to the riser 32, for the reasons discussed above. The specific structure of the stinger 30, illustrated in FIG. 4, provides this function and result.

Figure 4:
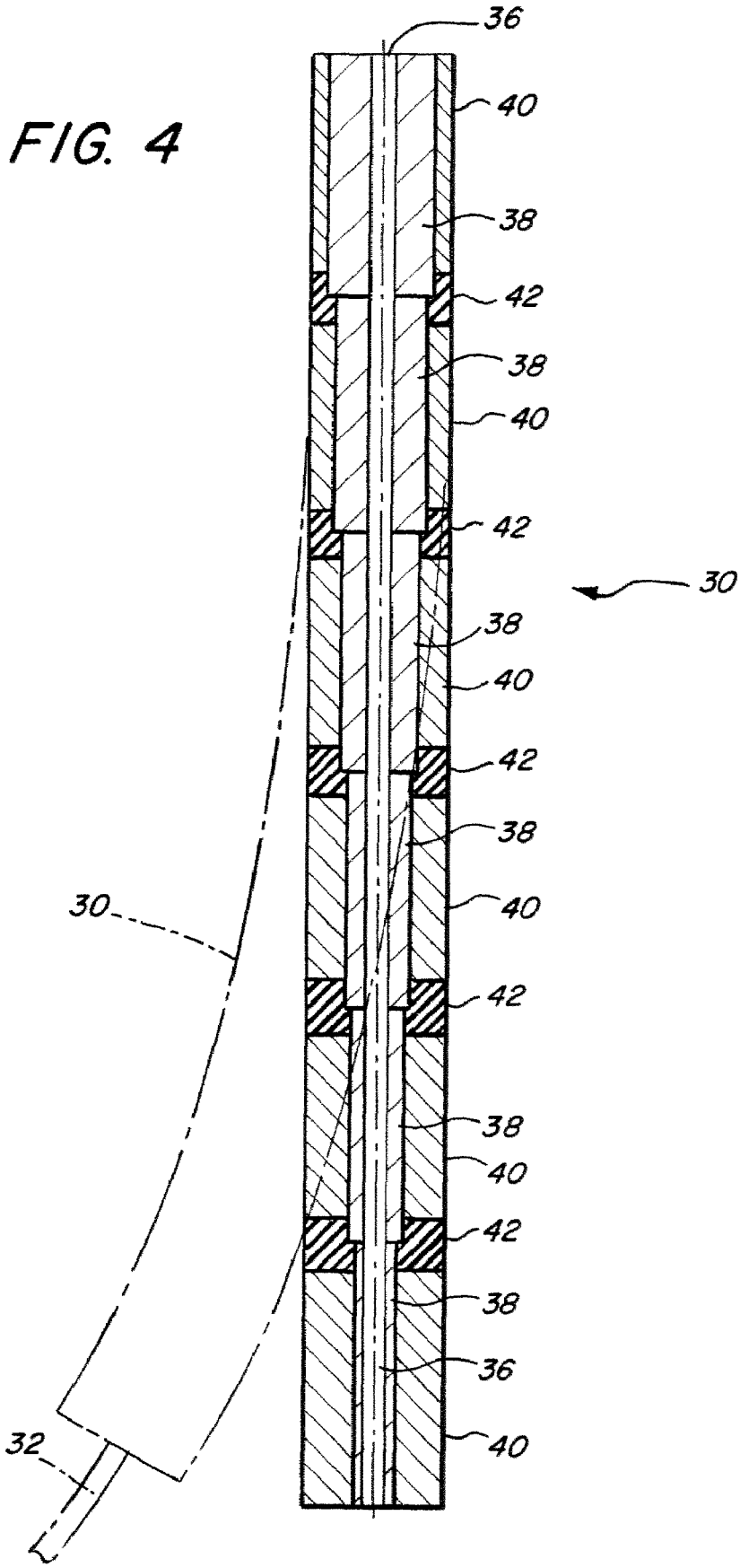
FIG. 4 is a detailed cross-sectional view of the bend-limiting stinger in accordance with a preferred embodiment of the present invention.

Specifically, as shown in FIG. 4, the bend-limiting stinger 30 of the present invention is a continuous flexible conduit defining a continuous bore or passage 36 sized to receive a riser (SCR) 32 therethrough (as shown in the phantom outline). The conduit is formed from a plurality of axial sections or segments, each comprising a steel pipe section or "joint" 38, joined axially (end-to-end). Each of the joints or sections 38 may preferably be about 10-13 meters in length, with substantially equal inside diameters, so that the bore 36 is likewise of uniform diameter throughout its length. The joints or sections 38 (typically, but not necessarily, eight to ten in number) may be welded to each other or mechanically joined to each other by conventional connection means (not shown) that are well-known in the art. As described in detail below, the stinger 30 has progressively increasing flexibility or compliance from the upper end to the lower end. Advantageously, the stinger 30 also progressively increases in weight per unit length from the upper end to the lower end.

In the specific preferred embodiment illustrated in FIG. 4, each of the pipe sections or joints 38 below the uppermost joint 38 has an outside diameter that is slightly less than that of the joint immediately above it. In other words, the wall thickness of each successive joint below the uppermost joint is somewhat less than that of the joint immediately above it, providing a stepwise graduated reduction in wall thickness (and thus outside diameter) from each joint to the joint immediately below it. The rate of wall thickness (or outside diameter) reduction does not need to be constant throughout the length of the stinger 30, and it will be dictated by the specific degree of stiffness (or, conversely, flexibility) desired in each pipe section 38.

Also, in the preferred embodiment, weight per unit length is increased for each successive joint 38 below the uppermost joint by applying a weight "jacket" 40 of increasing thickness (and thus increasing weight or mass) on each successive joint 38 below the uppermost joint. In a specific exemplary embodiment, the weight jacket 40 comprises one or more layers of weighted metallic tape (e.g., lead tape) applied to the outside surface of each joint 38. Each successive joint 38 below the uppermost joint is provided with a greater number of tape layers than the joint immediately above it. Alternatively, the weight jackets 40 may be in the form of weighted collars installed on the pipe joints 38, or concrete pre-cast onto the pipe joints 38, with the collar weights or concrete casting thicknesses being distributed so that each successive pipe joint 38 has a greater weight than the joint immediately above it. The distribution of the weights makes the lower end of the bend limiting stinger 30 heavier (per unit length) than the upper end, without affecting the greater compliance of the lower end due to the lesser pipe wall thicknesses as compared to the upper end.

The weight jackets 40 are advantageously applied to all or some of the pipe sections or joints 38 before installation. Optionally, and advantageously, similarly weighted "field joint" weights 42 may be applied at some or all of the junctures of the pipe sections 38 after installation. Like the weight jackets 40, the field joint weights 42 increase in weight along the length of the stinger 30 from top to bottom. Also, like the weight jackets 40, the field joint weights 42 are preferably formed of weighted metal tape, although discrete weighted elements (e.g., collars) may also be used.

The above-described structure that increases in flexibility and weight per unit length of the stinger 30 from its top end to its bottom end results in a lateral load being applied to the riser 32 as it passes through the stinger 30, thereby causing a gentle and gradual transition in the SCR from a curved configuration at the lower end of the stinger 30, to a straight configuration as it emerges from the upper end of the stinger 30. The specific variations of flexibility and weight (or mass) of the stinger 30 will be dictated by the physical characteristics of the riser 32, such as its area of inertia, outside diameter, and Young's modulus. The design consideration is to keep the stress induced in the riser 32 below a predetermined limit, wherein the stress σ is directly proportional to the bending moment, as set forth in the following equation:

$$\sigma = mc/ei \quad (1)$$

where m is the bending moment applied to the riser;

c is the outside radius of the riser;

e is Young's modulus; and i is the area of inertia of the riser.

Figure 2:
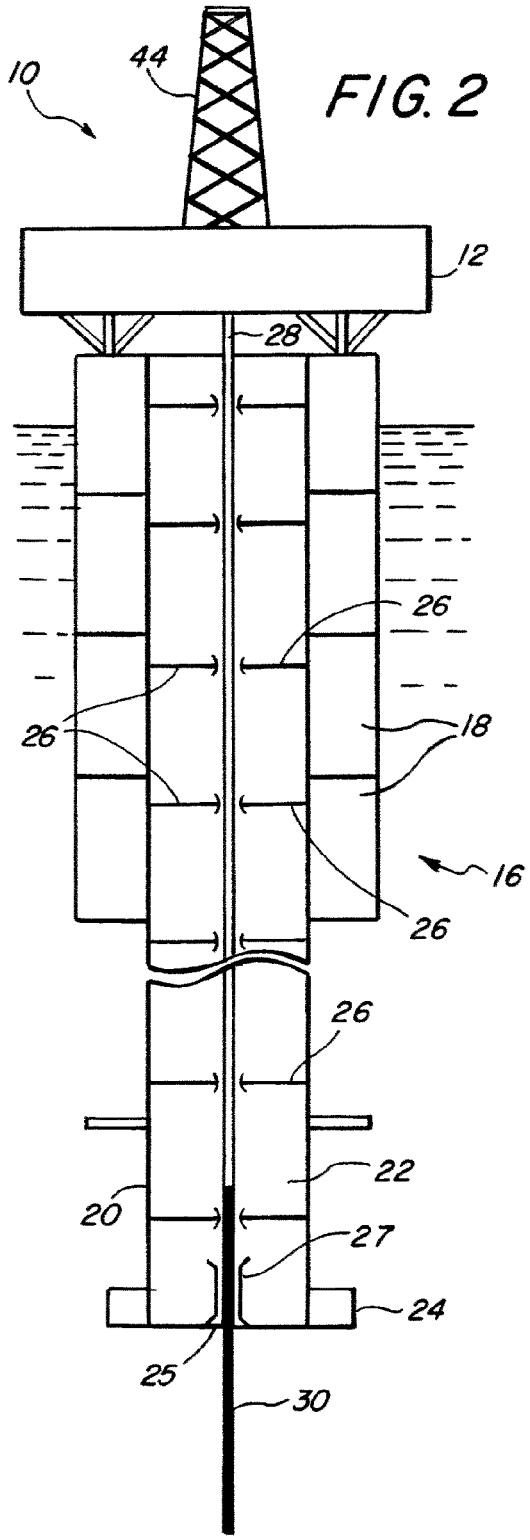
FIGS. 2 and 3 are cross-sectional views, similar to that of FIG. 1, showing the process of installing a bend-limiting stinger in accordance with the present invention.
Figure 3:
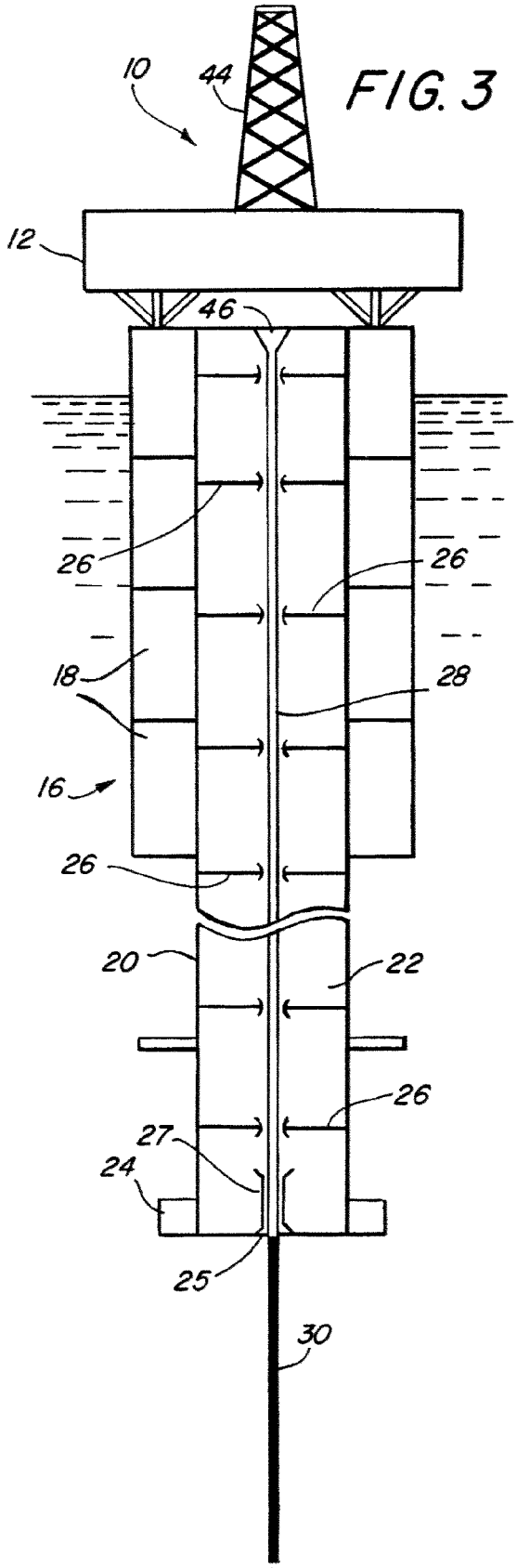

The preferred method of installing the bend-limiting stinger 30 of the present invention is illustrated in FIGS. 2 and 3. The maximum outside diameter of the stinger 30 is less than the diameter of the passage defined by the riser guides 26 and the keel slot guide 27 in the centerwell 22 of the platform 10. This allows the bend limiting stinger 30 of the present invention to be installed from the deck 12 of the platform 10 by attaching it to the lower end of a casing 28 that is then run down the centerwell 22 from a drilling or work-over rig 44 on the deck 12, through the riser guides 30 and the keel slot guide 27, until the upper end of the stinger 30 is seated in the keel 24. The upper end of the casing 28 is then secured in a fixture 46 at or near the top of the hull 16. The stinger 30 is now installed so that the riser 32 may be run through it. Alternatively, the stinger 30 may be attached to the end of a drill pipe string (not shown) that is run down the centerwell 22 until the top end of the stinger 30 is seated in the keel 24, whereupon the drill pipe string is detached from the stinger and withdrawn up the centerwell 22.

While a preferred embodiment of the invention has been described above and illustrated in the drawings, it is understood that this embodiment is exemplary only as the currently preferred embodiment of the invention. It will be appreciated that a number of variations and modifications will suggest themselves to those skilled in the pertinent arts. Such variations, modifications, and equivalents should be considered within the spirit and scope of the invention, as defined in the claims that follow.

What is claimed is:

1. For use with a spar-type offshore platform having a central hull column defining a centerwell and having a bottom end terminating in a keel, a bend-limiting conduit for a catenary riser extending from the seafloor into the centerwell of the platform through the keel of the platform, wherein the bend limiting conduit extends from an upper end constrained within the keel of the platform to a lower end disposed below the keel, the conduit defining a bore dimensioned to receive the riser, the bend-limiting conduit being characterized in that the conduit has progressively increasing flexibility or compliance from the upper end to the lower end.

2. The bend-limiting conduit of claim 1, further characterized in that the conduit in-creases in weight per unit length from the upper end to the lower end.

3. The bend-limiting conduit of claim 1, wherein the conduit comprises a plurality of axial segments joined end-to end, with the segments decreasing in weight from the lower end to the upper end.

4. The bend-limiting conduit of claim 1, wherein the conduit comprises a series of steel pipe sections of uniform inside diameter, joined end-to-end, wherein each of the pipe sections below an uppermost section has an outside diameter that is slightly less than that of the section immediately above it.

5. The bend-limiting conduit of claim 4, wherein each successive pipe section below the uppermost section has a smaller wall thickness than the section immediately above it.

6. The bend-limiting conduit of claim 4, wherein each successive pipe section below the uppermost section has a greater weight than the section immediately above it.

7. The bend-limiting conduit of claim 6, wherein each successive pipe section below the uppermost section includes a weighted jacket of greater weight than the jacket of the section immediately above it.

8. The bend-limiting conduit of claim 7, wherein the jacket comprises one or more layers of weighted metallic tape applied to the outside surface of each section, and wherein each successive section below the uppermost section is provided with a greater number of tape layers than the section immediately above it.

9. The bend-limiting conduit of claim 7, wherein the jacket includes a weighted collar.

10. The bend-limiting conduit of claim 7, wherein the jacket is formed of concrete cast directly onto each pipe section.

11. A method of installing a bend-limiting conduit in a spar-type offshore platform having a hull having a top end and a bottom end, a deck secured to the top end of the hull, a centerwell extending axially through the hull below the deck, a plurality of riser guides in the centerwell, and a keel at the bottom end of the hull with a keel slot guide therein, the riser guides and the keel slot guide defining an axial passage through the centerwell and the keel, the passage having an internal diameter, the method comprising:

(a) providing a bend-limiting conduit having an outside diameter that is less than the internal diameter of the passage;

(b) providing a casing having an upper end and a lower end;

(c) attaching the bend-limiting conduit to the lower end of the casing;

(d) running the bend-limiting conduit and the casing down the centerwell from the deck, through the riser guides and the keel slot guide, until the upper end of the conduit is seated in the keel; and (e) securing the upper end of the casing near the top of the hull.

12. The method claim 11, wherein the conduit increases in weight per unit length from the upper end to the lower end.

13. The method of claim 11, wherein the conduit comprises a plurality of axial segments joined end-to end, with the segments decreasing in weight from the lower end to the upper end.

14. The method of claim 11, wherein the conduit comprises a series of steel pipe sections of uniform inside diameter, joined end-to-end, wherein each of the pipe sections below an uppermost section has an outside diameter that is slightly less than that of the section immediately above it.

15. The method of claim 14, wherein each successive pipe section below the upper-most section has a smaller wall thickness than the section immediately above it.

16. The method of claim 14, wherein each successive pipe section below the upper-most section has a greater weight than the section immediately above it.

17. The method of claim 16, wherein each successive pipe section below the upper-most section includes a weighted jacket of greater weight than the jacket of the section immediately above it.

18. The method of claim 17, wherein the jacket comprises one or more layers of weighted metallic tape applied to the outside surface of each section, and wherein each successive section below the uppermost section is provided with a greater number of tape layers than the section immediately above it.

19. The method of claim 17, wherein the jacket includes a weighted collar.

20. The method of claim 17, wherein the jacket is formed of concrete cast directly onto each pipe section.

21. A method of installing a bend-limiting conduit in a spar-type offshore platform having a hull with a top end and a bottom end, a deck secured to the top end of the hull, a centerwell extending axially through the hull below the deck, a plurality of riser guides in the centerwell, and a keel at the bottom end of the hull with a keel slot guide therein, the riser guides and the keel slot guide defining an axial passage through the centerwell and the keel, the passage having an internal diameter, the method comprising:

(a) providing a bend-limiting conduit having an outside diameter that is less than the internal diameter of the passage;

(b) providing a drill pipe string having a lower end;

(c) attaching the bend-limiting conduit to the lower end of the drill pipe string;

(d) running the bend-limiting conduit and the drill pipe string down the centerwell from the deck, through the riser guides and the keel slot guide, until the upper end of the conduit is seated in the keel;

(e) detaching the drill pipe string from the bend-limiting conduit; and (f) removing the drill pipe string from the centerwell.

22. The method claim 21, wherein the conduit increases in weight per unit length from the upper end to the lower end.

23. The method of claim 21, wherein the conduit comprises a plurality of axial segments joined end-to end, with the segments decreasing in weight from the lower end to the upper end.

24. The method of claim 21, wherein the conduit comprises a series of steel pipe sections of uniform inside diameter, joined end-to-end, wherein each of the pipe sections below an uppermost section has an outside diameter that is slightly less than that of the section immediately above it.

25. The method of claim 24, wherein each successive pipe section below the upper-most section has a smaller wall thickness than the section immediately above it.

26. The method of claim 24, wherein each successive pipe section below the upper-most section has a greater weight than the section immediately above it.

27. The method of claim 26, wherein each successive pipe section below the upper-most section includes a weighted jacket of greater weight than the jacket of the section immediately above it.

28. The method of claim 27, wherein the jacket comprises one or more layers of weighted metallic tape applied to the outside surface of each section, and wherein each successive section below the uppermost section is provided with a greater number of tape layers than the section immediately above it.

29. The method of claim 27, wherein the jacket includes a weighted collar.

30. The method of claim 27, wherein the jacket is formed of concrete cast directly onto each pipe section.

* * * * *